US011512704B2

(12) United States Patent
Tzeng

(10) Patent No.: US 11,512,704 B2
(45) Date of Patent: Nov. 29, 2022

(54) COUNTER-ROTATING AXIAL AIR MOVING DEVICE

(71) Applicant: Stokes Technology Development Ltd., Taoyuan (TW)

(72) Inventor: Yih-Wei Tzeng, Taoyuan (TW)

(73) Assignee: STOKES TECHNOLOGY DEVELOPMENT LTD., Taoyuan (TW)

( * ) Notice: Subject to any disclaimer, the term of this patent is extended or adjusted under 35 U.S.C. 154(b) by 0 days.

(21) Appl. No.: 17/229,788

(22) Filed: Apr. 13, 2021

(65) Prior Publication Data

US 2022/0325717 A1 Oct. 13, 2022

(51) Int. Cl.

| | |
|---|---|
| ***F04D 19/00*** | (2006.01) |
| ***F04D 29/54*** | (2006.01) |
| ***F04D 19/02*** | (2006.01) |

(52) U.S. Cl.

CPC ..... *F04D 19/007* (2013.01); *F04D 19/024* (2013.01); *F04D 29/544* (2013.01)

(58) Field of Classification Search

CPC ..... F04D 19/007; F04D 19/024; F04D 29/544
See application file for complete search history.

(56) References Cited

U.S. PATENT DOCUMENTS

| | | | | |
|---|---|---|---|---|
| 5,511,942 | A * | 4/1996 | Meier | F04D 29/544 415/220 |
| 8,764,375 | B2 * | 7/2014 | Kato | F04D 29/544 415/68 |
| 2005/0110366 | A1 * | 5/2005 | Chang | H02K 7/14 310/68 B |
| 2007/0286727 | A1 * | 12/2007 | Chang | F04D 25/082 415/228 |
| 2008/0031722 | A1 * | 2/2008 | Yoshida | F04D 19/007 415/68 |
| 2008/0260526 | A1 * | 10/2008 | Nishizawa | F04D 25/0613 415/199.4 |
| 2018/0195526 | A1 * | 7/2018 | Hakozaki | F04D 19/002 |
| 2020/0056618 | A1 * | 2/2020 | Decker | F04D 19/007 |
| 2020/0217322 | A1 * | 7/2020 | Chang | F04D 29/386 |

* cited by examiner

*Primary Examiner* — Audrey B. Walter
(74) *Attorney, Agent, or Firm* — Chun-Ming Shih; HDLS IPR Services

(57) ABSTRACT

A counter-rotating axial air moving device includes a front rotor and a rear rotor. The front rotor includes a front hub and a plurality of front blades, and the number of the front blades is equal to or greater than 7 and equal to or less than 11. The rear rotor is disposed on the downstream side of the front rotor. The rear rotor includes a rear hub and a plurality of rear blades, and the number of the rear blades is equal to or greater than 6 and equal to or less than 10. The front rotor and the rear rotor are stacked with each other with a total thickness and a diameter. The ratio of the total thickness to the diameter is equal to or more than 0.91 and equal to or less than 1.5.

7 Claims, 8 Drawing Sheets

COUNTER-ROTATING AXIAL AIR MOVING DEVICE

BACKGROUND

Technical Field

The technical field relates to an axial air moving device, and more particularly relates to a counter-rotating axial air moving device.

Description of Related Art

An axial air moving device is composed of a motor, a hub and a plurality of blades arranged around the hub. The motor drives the hub to rotate to make the blades push the fluid flowing. Moreover, the axial air moving device has to generate not only high air flowrate, but also sufficient air pressure to effectively overcome the flow resistance of the environment. Accordingly, in order to improve the characteristics of static pressure-air flowrate of the axial air moving device, the configuration of contra-rotating is often adopted with adjusting the size and angle of the blades.

The counter-rotating axial air moving device of the related art usually increases the thickness of the device to achieve a higher air pressure. However, the increasing of the thickness is limited in application spaces of the related art. After the air pressure reached a certain level, the axial counter-rotating air moving device of the related art must increase the rotation speed for increasing the air flowrate. However, that may cause the deterioration of the vibration and noise of the counter-rotating axial air moving device. Additionally, the energy consumption, the manufacturing precision and the bearing quality need to be improved as well.

In view of the above drawbacks, the inventor proposes this disclosure based on his expert knowledge and elaborate researches in order to solve the problems of the related art.

SUMMARY OF THE DISCLOSURE

One object of this disclosure is to provide a counter-rotating axial air moving device having a performance curve with the better characteristic of static pressure versus air flowrate at the same rotation speed, so that the deterioration of vibration and noise may be avoided by not increasing the rotation speed. Additionally, the energy consumption is reduced, and the demand for the high manufacturing precision for ultra-high speed rotation may also be avoided.

In order to achieve the object mentioned above, this disclosure provides a counter-rotating axial air moving device design including a front rotor and a rear rotor. The front rotor includes a front hub and a plurality of front blades arranged annularly on a periphery of the font hub spacedly, and the number of the front blades is equal to or greater than 7 and equal to or less than 11 (is not greater than 11). The rear rotor is disposed on a downstream side of the front rotor, and the rear rotor includes a rear hub and a plurality of rear blades arranged annularly on a periphery of the rear hub spacedly, and the number of the rear blades is equal to or greater than 6 and equal to or less than 10 (is not greater than 10). The front rotor and the rear rotor are stacked with each other with a total a thickness and a diameter, and the ratio of the total thickness to the diameter is equal to or greater than 0.91 and equal to or less than 1.5 (is not greater than 1.5).

In the related arts, when the ratio of the total thickness to the diameter of the counter-rotating axial air moving device is in a range of 0.91 to 1.5, the amount of the front blades is 3 to 7, and the amount of the rear blades is 3 to 6. Comparing with the related art, the amount of the front blades of this disclosure is equal to or greater than 7 and equal to or less than 11, the amount of the rear blades is equal to or greater than 6 and equal to or less than 10, when the ratio of the total thickness to the diameter of the counter-rotating axial air moving device is equal to or greater than 0.91 and equal to or less than 1.5. With the proposed design, the counter-rotating axial air moving device of this disclosure has the better characteristics of static pressure versus air flowrate than that of the related art at the same rotation speed. Therefore, the deterioration of vibration and noise may be avoided with keeping the rotation speed. The energy consumption can be reduced, and the practicability of this disclosure is enhanced.

BRIEF DESCRIPTION OF DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
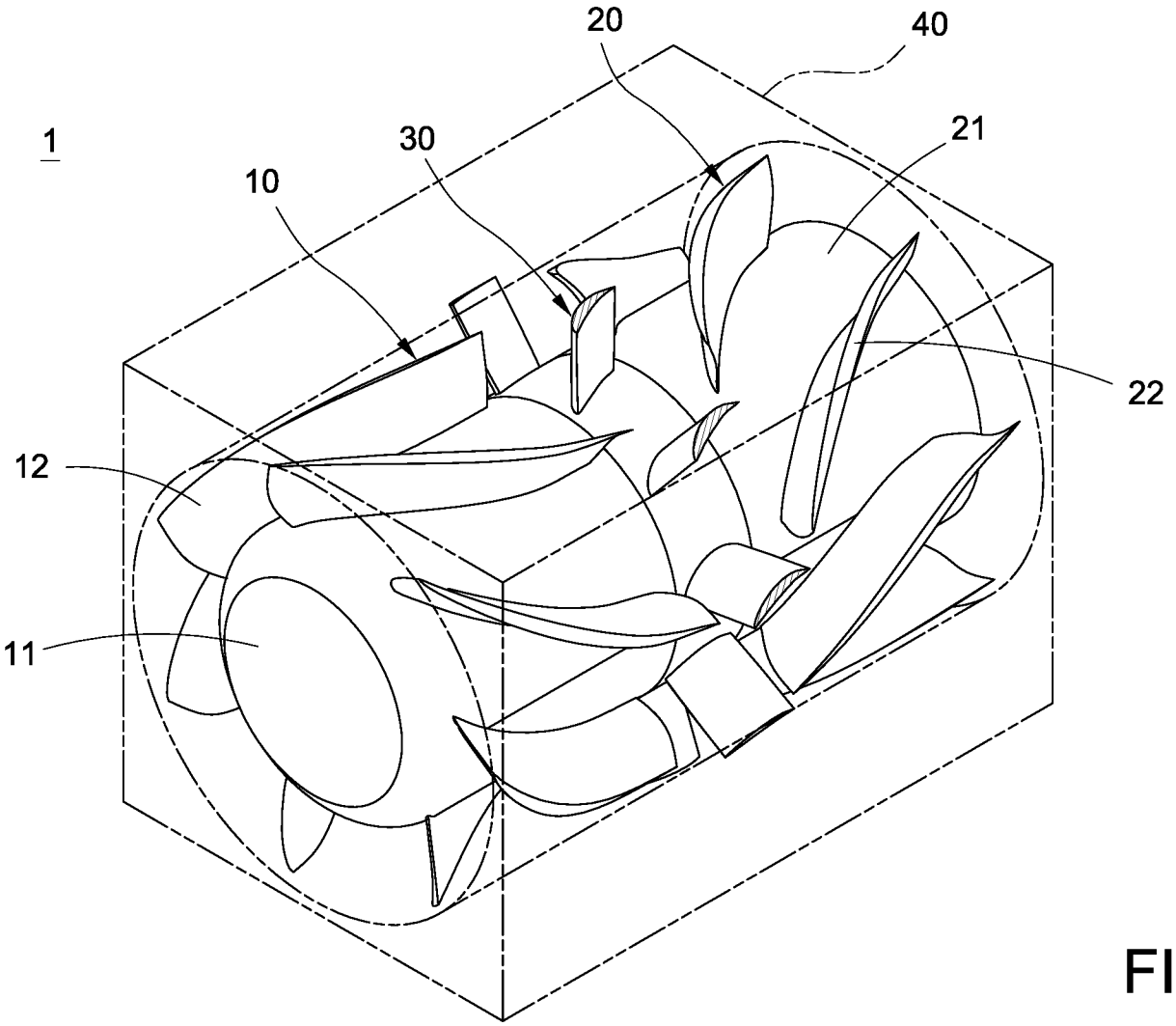
FIG. 1 is a perspective schematic view of the counter-rotating axial air moving device of this disclosure.
Figure 2:
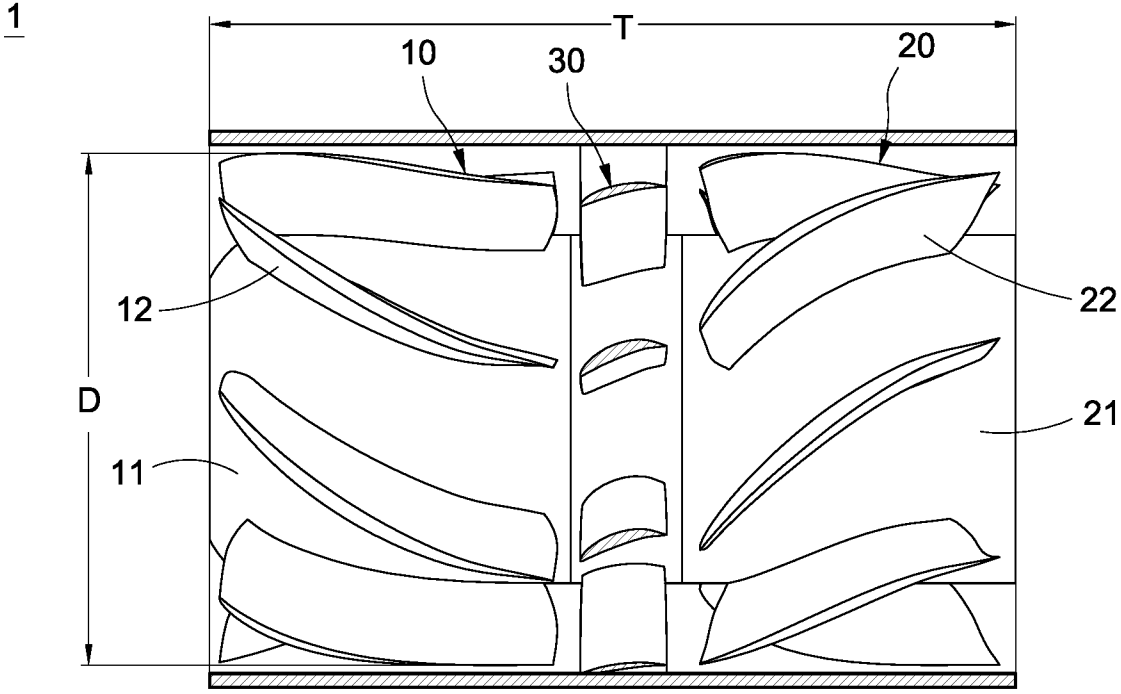
FIG. 2 is a side cross sectional view of the counter-rotating axial air moving device of this disclosure.

Please refer to FIG. 1 and FIG. 2, which depict a perspective schematic view and a side cross sectional view of the counter-rotating axial air moving device of this disclosure. The counter-rotating axial air moving device 1 of this disclosure includes a front rotor 10 and a rear rotor 20. The rear rotor 20 is disposed on the downstream side of the front rotor 10 to configure the counter-rotating axial air moving device 1. Additionally, the rotation directions of the front rotor 10 and the rear rotor 20 are opposite, and the diameter of the front rotor 10 and the diameter of the rear rotor 20 are the same.

The front rotor 10 includes a front hub 11 and a plurality of front blades 12 arranged annularly on the periphery of the font hub 11 spacedly, and the number of the front blades 12 is equal to or greater than 7 and equal to or less than 11.

Similarly, the rear rotor 20 includes a rear hub 21 and a plurality of rear blades 22 arranged annularly on the periphery of the rear hub 21 spacedly, and the number of the rear blades 22 is equal to or greater than 6 and equal to or less than 10.

Moreover, the front rotor 10 and the rear rotor 20 are stacked with each other to have a total thickness T and a diameter D. The ratio of the total thickness T to the diameter D is equal to or greater than 0.91 and equal to or less than 1.5.

Specifically, in this embodiment, the ratio of the total thickness T to the diameter D is 1.4. Furthermore, the amount of the front blades 12 is 7, and the amount of the rear blades 22 is also 7.

In one embodiment of this disclosure, the counter-rotating axial air moving device 1 further includes a stator component 30 and a housing 40. The stator component 30 is connected to the housing 40 and is optionally located on the front or rear side of the front rotor 10, on the rear side of the rear rotor 20 or between the front rotor 10 and the rear rotor 20. In some embodiments of this disclosure, the stator component 30 includes a plurality of pillars or a plurality of stator blades with wing sections. The pillars or the stator blades are arranged radially corresponding to the type of the rotor. In this embodiment, the stator element 30 includes a plurality of stator blades, and the function of the stator blades is to recover the rotational kinetic energy of the airflow.

It should be noted that the front rotor 10 has a front rotation speed, and the rear rotor 20 has a rear rotation speed. In some embodiments, the ratio of the rear rotation speed to the front rotation speed is equal to or greater than about 0.5 and equal to or less than about 1.2 (is not greater than 1.2).

Figure 3:
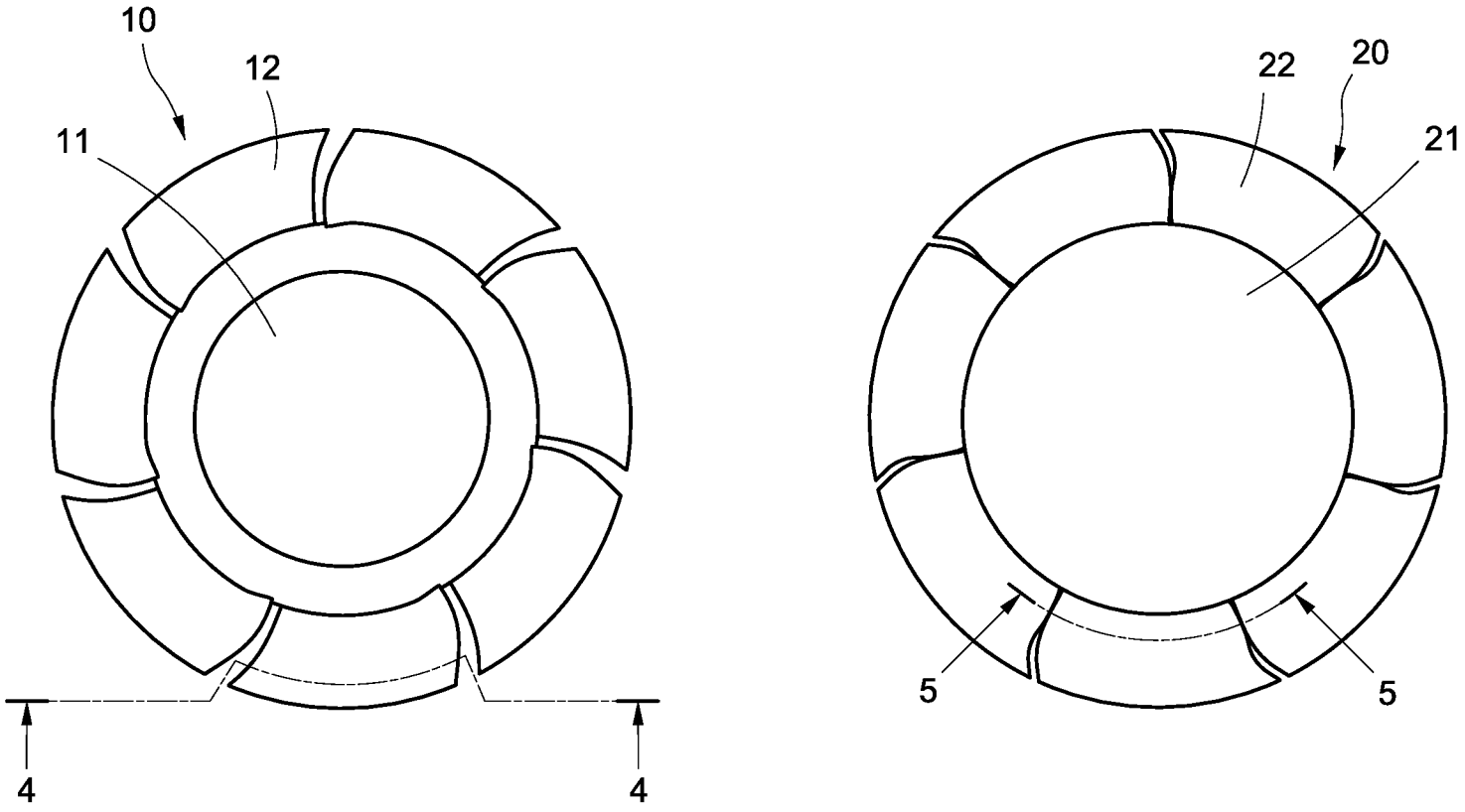
FIG. 3 is a top view of the front rotor and the rear rotor of this disclosure.
Figure 5:
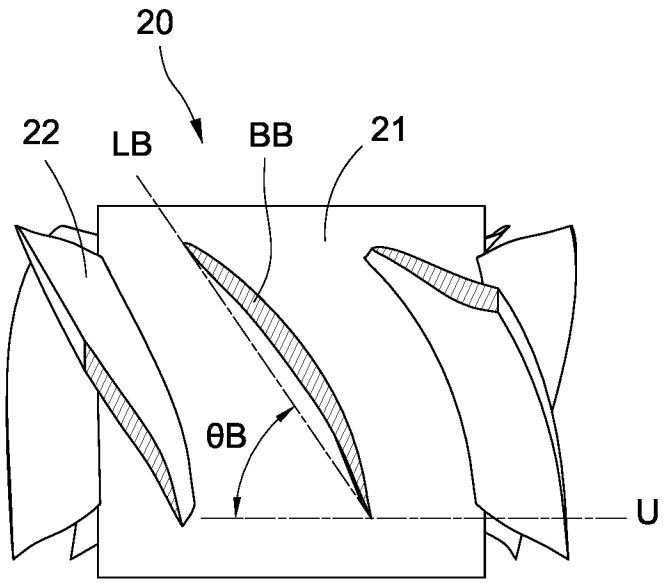
FIG. 5 is a schematic view of the pitch angle of the rear rotor of this disclosure.
Figure 4:
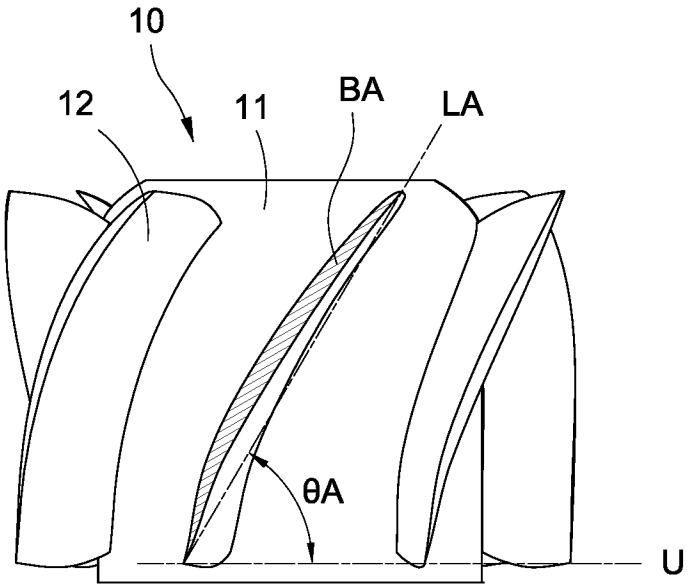
FIG. 4 is a schematic view of the pitch angle of the front rotor of this disclosure.

Please further refer to FIG. 3 to FIG. 5, which depict a top view of the front rotor and the rear rotor of this disclosure, a schematic view of the pitch angle of the front rotor blade of this disclosure, and a schematic view of the pitch angle of the rear rotor blade of this disclosure. In the FIG. 3, the cross-sectional view is made along the line 4-4 of the front blades 12 to form a wing section BA. The angle formed by the nose-tail line LA of the wing section BA and the rotation direction U of the front rotor 10 is defined as the pitch angle $\theta_A$.

Moreover, the cross-sectional view is made along the line 5-5 of the rear blades 22 to form another wing section BB. The angle formed by the nose-tail line LB of the wing section BB and the rotation direction U of the rear rotor 20 is defined as the pitch angle $\theta_B$.

It is worth of noticing that the pitch angles of the wing sections on different radius positions may be different. The $\theta_A$ mentioned afterward refers to the average pitch angle of the front blades, and the $\theta_B$ mentioned afterward refers to the average pitch angle of the rear blades. The average pitch angle $\theta_A$ of the front blades 12 of the counter-rotating axial air moving device 1 of this disclosure is greater than about 55 degrees and less than about 72 degrees. Additionally, the average pitch angle $\theta_B$ of the rear blades 22 is greater than about 50 degrees and less than about 67 degrees. The average pitch angle $\theta_B$ of the rear blades 22 is smaller than the average pitch angle $\theta_A$ of the front blades 12.

In this embodiment, the average pitch angle $\theta_A$ of the front blades 12 is about 60.8 degrees. Moreover, the average pitch angle $\theta_B$ of the rear blades 22 is about 54 degrees.

Figure 6:
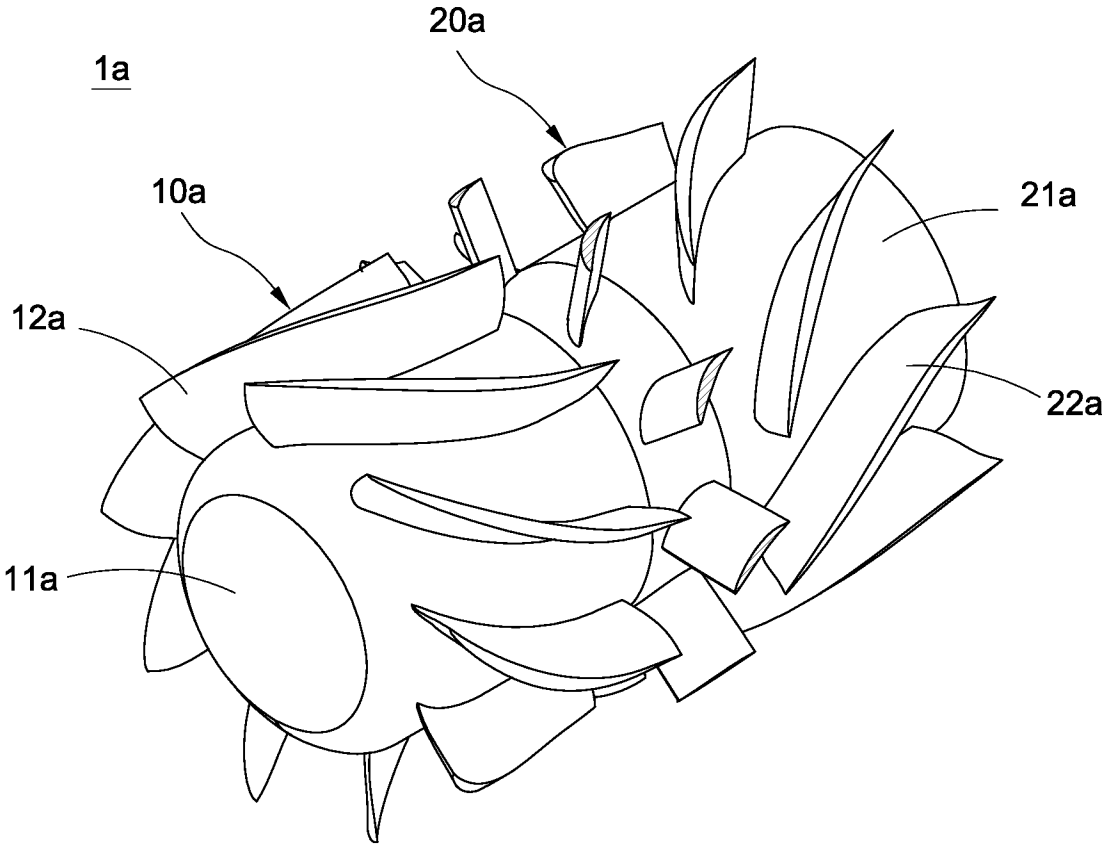
FIG. 6 is a perspective schematic view of another embodiment of the counter-rotating axial air moving device of this disclosure.
Figure 7:
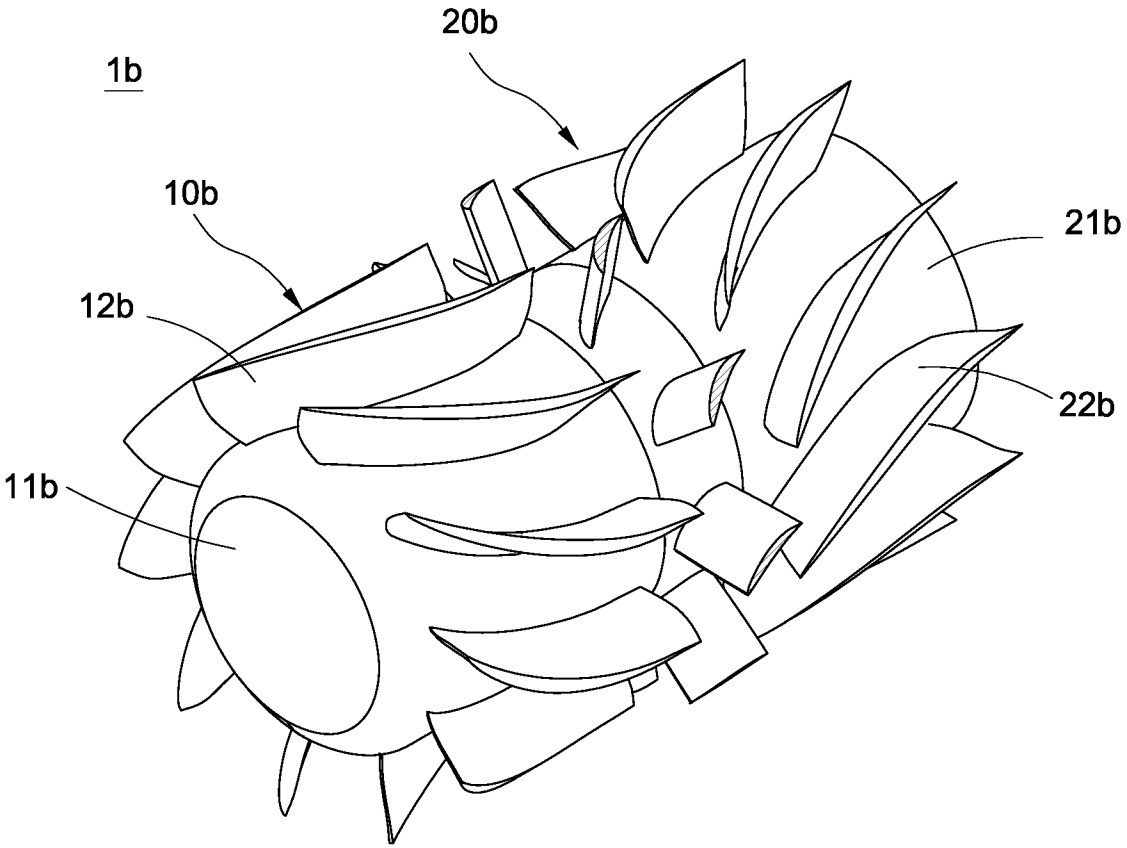
FIG. 7 is a perspective schematic view of still another embodiment of the counter-rotating axial air moving device of this disclosure.
Figure 8:
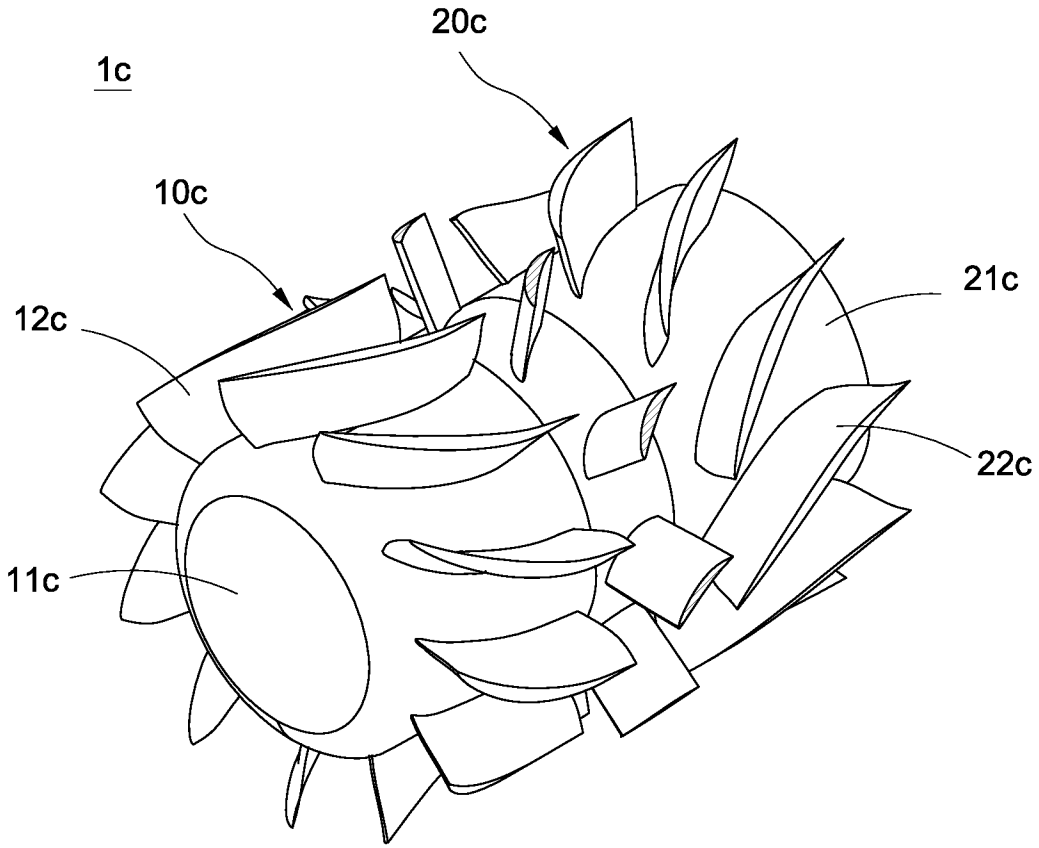
FIG. 8 is a perspective schematic view of another embodiment of the counter-rotating axial air moving device of this disclosure.

Please further refer to FIG. 6 to FIG. 8, which depict the other three embodiments of the counter-rotating axial air moving device of this disclosure. The differences between these three embodiments and the previous embodiment are the number of the front blades and the number of the rear blades, and the average pitch angle of the front blades and the average pitch angle of the rear blades.

As shown in the FIG. 6, in this embodiment, the counter-rotating axial air moving device 1*a* includes a front rotor 10*a* and a rear rotor 20*a*. The front rotor 10*a* includes a front hub 11*a* and a plurality of front blades 12*a*, and the number of the front blades 12*a* is 9. Additionally, the rear rotor 20*a* includes a rear hub 21*a* and a plurality of rear blades 22*a*, and the number of rear blades 12*a* is 8.

Furthermore, in this embodiment, the average pitch angle $\theta_A$ of the front blades 12*a* is about 61 degrees. Moreover, the average pitch angle $\theta_B$ of the rear blades 22*a* is about 54.5 degrees.

Please refer to FIG. 7, in this embodiment, the counter-rotating axial air moving device 1*b* includes a front rotor 10*b* and a rear rotor 20*b*. The front rotor 10*b* includes a front hub 11*b* and a plurality of front blades 12*b*, and the number of the front blades 12*b* is 10. Additionally, the rear rotor 20*b* includes a rear hub 21*b* and a plurality of rear blades 22*b*, and the number of the rear blades 12*b* is also 10.

Moreover, in this embodiment, the average pitch angle $\theta_A$ of the front blades 12*b* is about 68.5 degrees. The average pitch angle $\theta_B$ of the rear blades 22*b* is about 65 degrees.

Please further refer to FIG. 8, in this embodiment, the counter-rotating axial air moving device 1*c* includes a front rotor 10*c* and a rear rotor 20*c*. The front rotor 10*c* includes a front hub 11*c* and a plurality of front blades 12*c*, and the number of the front blades 12*c* is 11. Additionally, the rear rotor 20*c* includes a rear hub 21*c* and a plurality of rear blades 22*c*, and the number of rear blades 22*c* is 10.

Moreover, in this embodiment, the average pitch angle $\theta_A$ of the front blades 12*c* is about 67.7 degrees. The average pitch angle $\theta_B$ of the rear blades 22*c* is about 58.1 degrees.

Figure 9:
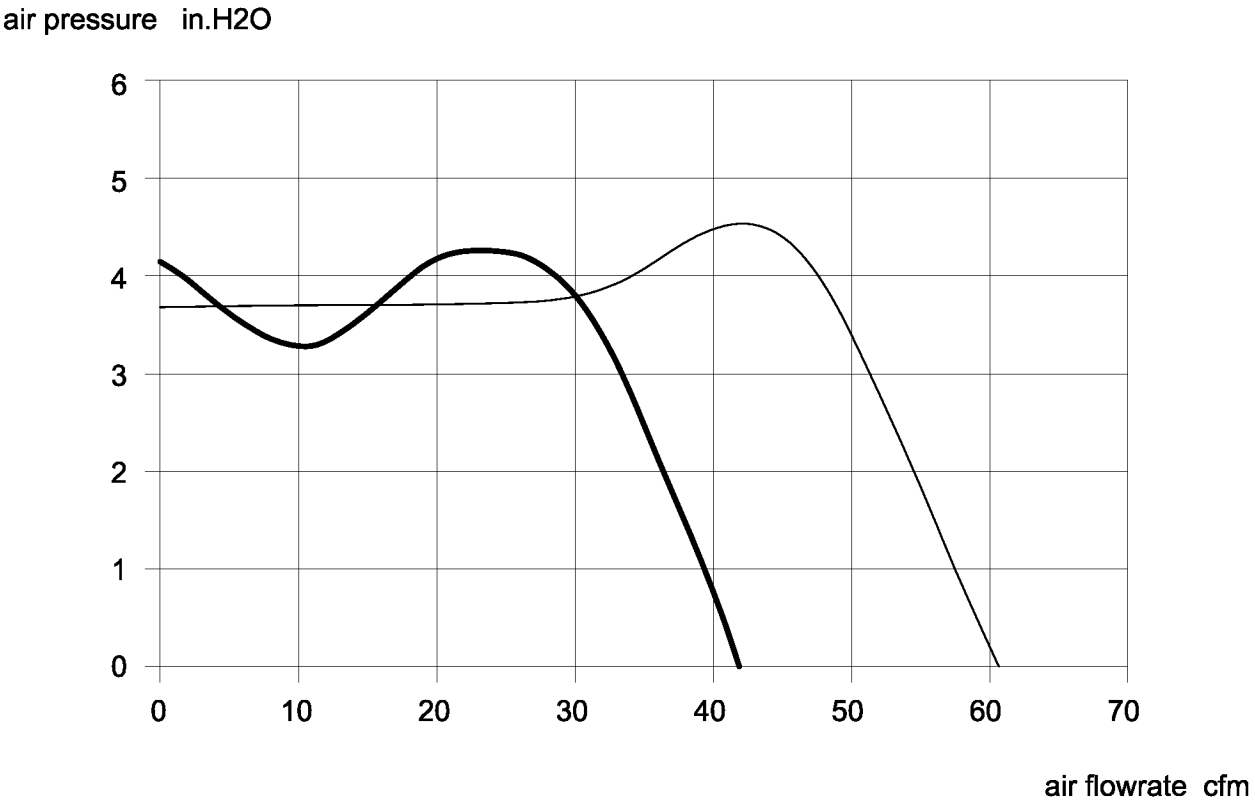
FIG. 9 is a comparison diagram of the curves of the static pressure versus air flowrate of the counter-rotating axial air moving device of this disclosure and the counter-rotating axial air moving device of the related art.

Please refer to FIG. 9, which depicts a comparison diagram of the curves of the static pressure-air flowrate of the counter-rotating axial air moving device of this disclosure and the counter-rotating axial air moving device of the related art under the same size and the same rotation speed. It is shown in the figures, under the same air pressure, the curve of the characteristic of the counter-rotating axial air moving device of this disclosure (represented in the thin line) is in a higher air flowrate region comparing with the counter-rotating axial air moving device of the related art (represented in the thick line). In other words, in the environment of the same flow resistance, the counter-rotating axial air moving device of this disclosure provides the higher air flowrate. Accordingly, at the same rotating speed, the counter-rotating axial air moving device of this disclosure provides the better characteristics and performance than the counter-rotating axial air moving device of the related art. Therefore, the deterioration of vibration and noise caused by increasing the rotation speed may be avoided, and the energy consumption may be reduced.

While this disclosure has been described by means of specific embodiments, numerous modifications and variations could be made thereto by those skilled in the art without departing from the scope and spirit of this disclosure set forth in the claims.

What is claimed is:

1. A counter-rotating axial air moving device, comprising:

a front rotor, comprising a front hub and a plurality of front blades arranged annularly on a periphery of the front hub spacedly, and an amount of the front blades being equal to or greater than nine and equal to or less than eleven;

a rear rotor, disposed on a downstream side of the front rotor, comprising a rear hub and a plurality of rear blades arranged annularly on a periphery of the rear hub spacedly, and an amount of the rear blades being equal to or greater than seven and equal to or less than ten; and a stator component, located on a front or rear side of the front rotor, on a rear side of the rear rotor, or between the front rotor and the rear rotor;

wherein, the front rotor and the rear rotor are stacked with each other with a total thickness and a diameter, and a ratio of the total thickness to the diameter is equal to or greater than 0.91 and equal to or less than 1.5, and wherein the total thickness means a thickness of the front hub, the stator component, and the rear hub in an axial direction, and the diameter means a diameter of an outer diameter of the front blades or rear blades.

2. The counter-rotating axial air moving device according to claim 1, wherein the front rotor and the rear rotor rotate in opposite direction, and a diameter of the front rotor and a diameter of the rear rotor are the same.

3. The counter-rotating axial air moving device according to claim 1, wherein the front rotor comprises a front rotation speed, and the rear rotor comprises a rear rotation speed, and a ratio of the rear rotation speed to the front rotation speed is equal to or greater than 0.5 and equal to or less than 1.2.

4. The counter-rotating axial air moving device according to claim 1, wherein the stator component comprises a plurality of pillars or a plurality of stator blades, and the pillars or the stator blades are arranged radially.

5. The counter-rotating axial air moving device according to claim 1, wherein an average pitch angle of the front blades is greater than 55 degrees and less than 72 degrees.

6. The counter-rotating axial air moving device according to claim 5, wherein an average pitch angle of the rear blades is less than the average pitch angle of the front blades.

7. The counter-rotating axial air moving device according to claim 6, wherein the average pitch angle of the rear blades is greater than 50 degrees and less than 67 degrees.

* * * * *